US006085700A

United States Patent [19]

Overbey, Jr.

[11] Patent Number: 6,085,700

[45] **Date of Patent: *Jul. 11, 2000**

[54] HEAT SENSITIVE AIR INLETS FOR WATER HEATERS

[75] Inventor: Fred A. Overbey, Jr., Bristol, Tenn.

[73] Assignee: SRP 687 Pty Ltd., Australia

[ * ] Notice: This patent is subject to a terminal disclaimer.

[21] Appl. No.: 09/243,900

[22] Filed: Feb. 3, 1999

Related U.S. Application Data

[62] Division of application No. 09/138,324, Aug. 21, 1998.

[51] Int. Cl.[7] ..... F22B 5/00; F24H 1/18

[52] U.S. Cl. ..... 122/13.1; 122/17; 126/350 R; 431/354

[58] Field of Search ..... 122/5.51, 13.1, 122/14, 17, 18; 126/42, 350 R; 431/22, 346, 354

[56] References Cited

U.S. PATENT DOCUMENTS

| | | |
|---|---|---|
| 360,199 | 3/1887 | Boegler . |
| 626,454 | 6/1899 | Brintnall . |
| 736,153 | 8/1903 | Reynolds . |
| 796,924 | 8/1905 | McCartney . |
| 1,398,986 | 12/1921 | Warnock . |
| 1,661,193 | 3/1928 | Newport . |
| 1,692,839 | 11/1928 | Humphrey . |
| 1,806,216 | 5/1931 | Plummer . |
| 1,841,463 | 1/1932 | Barber et al. . |
| 2,008,155 | 7/1935 | Ramsdell et al. . |
| 2,036,136 | 3/1936 | Guarcello . |
| 2,070,535 | 2/1937 | Hansen . |
| 2,112,655 | 3/1938 | Morrow . |
| 2,429,916 | 10/1947 | Belgau . |
| 2,479,042 | 8/1949 | Gaines . |
| 2,499,636 | 3/1950 | Finley . |
| 2,559,110 | 7/1951 | Burwell . |
| 3,139,067 | 6/1964 | Van Den Brock et al. . |
| 3,161,227 | 12/1964 | Goss et al. . |
| 3,741,166 | 6/1973 | Bailey . |
| 3,920,375 | 11/1975 | Sanderson et al. . |
| 3,947,229 | 3/1976 | Richter . |
| 4,039,272 | 8/1977 | Elliott . |
| 4,080,149 | 3/1978 | Wolfe . |
| 4,177,168 | 12/1979 | Denny et al. . |
| 4,191,173 | 3/1980 | Dedeian et al. . |
| 4,204,833 | 5/1980 | Kmetz et al. . |
| 4,241,723 | 12/1980 | Kitchen . |
| 4,480,988 | 11/1984 | Okabayashi et al. . |
| 4,510,890 | 4/1985 | Cowan . |
| 4,519,770 | 5/1985 | Kesselring et al. . |
| 4,565,523 | 1/1986 | Berkelder . |
| 4,639,213 | 1/1987 | Simpson . |
| 4,641,631 | 2/1987 | Jatana . |
| 4,742,800 | 5/1988 | Eising . |

(List continued on next page.)

FOREIGN PATENT DOCUMENTS

| | | |
|---|---|---|
| 0 560 419 A2 | 9/1993 | European Pat. Off. . |
| 0 596 555 A1 | 5/1994 | European Pat. Off. . |
| 0 657 691 A1 | 6/1995 | European Pat. Off. . |
| 25 40 709 A1 | 3/1977 | Germany . |
| 39 26 699 A1 | 2/1991 | Germany . |
| 60-134117 | 7/1985 | Japan . |
| 62-162814 | 7/1987 | Japan . |
| WO 94/01722 | 1/1994 | WIPO . |

OTHER PUBLICATIONS

"Flame Traps—a Technical Note" Journal of Mines, Metals & Fuels, Jul. 1987.

*Primary Examiner*—Denise L. Ferensic
*Assistant Examiner*—Gregory A. Wilson
*Attorney, Agent, or Firm*—T. Daniel Christenbury

[57] ABSTRACT

A gas water heater including a water container adapted to be heated by a gas burner; and an enclosure surrounding the burner, the enclosure having at least one heat sensitive entryway adapted to allow air and fumes to enter the enclosure without igniting flammable gases or vapors outside of the enclosure.

12 Claims, 7 Drawing Sheets

U.S. PATENT DOCUMENTS 4,777,933 10/1988 Ruark .
4,790,268 12/1988 Eising .
4,817,564 4/1989 Akkala et al. .
4,823,770 4/1989 Loeffler .
4,863,370 9/1989 Yokoyama et al. .
4,869,232 9/1989 Narang .
4,872,443 10/1989 Ruark .
4,893,609 1/1990 Girodani et al. .
4,919,085 4/1990 Ishiguro .
4,924,816 5/1990 Moore, Jr. et al. .
4,960,078 10/1990 Yokoyama et al. .
5,020,512 6/1991 Vago et al. .
5,044,928 9/1991 Yokoyama et al. .
5,085,205 2/1992 Hall et al. .
5,197,456 3/1993 Ryno .
5,205,731 4/1993 Reuther et al. .
5,215,457 6/1993 Sebastiani .
5,240,411 8/1993 Abalos .
5,246,397 9/1993 Petter .
5,261,438 11/1993 Katchka .
5,317,992 6/1994 Joyce .
5,335,646 8/1994 Katchka .
5,355,841 10/1994 Moore, Jr. et al. .
5,368,263 11/1994 Harrison .
5,385,467 1/1995 Sebastiani et al. .
5,397,233 3/1995 Eavenson et al. .
5,405,263 4/1995 Gerdes et al. .
5,427,525 6/1995 Shukla et al. .
5,435,716 7/1995 Joyce .
5,448,969 9/1995 Stuart et al. .
5,494,003 2/1996 Bartz .
5,520,536 5/1996 Rodgers et al. .
5,522,723 6/1996 Durst et al. .
5,531,214 7/1996 Cheek .
5,556,272 9/1996 Blasko et al. .
5,575,274 11/1996 DePalma .
5,588,822 12/1996 Hayakawa .
5,649,821 7/1997 Fogliani et al. .
5,649,822 7/1997 Gertler et al. .
5,674,065 10/1997 Grando et al. .
5,791,298 8/1998 Rodgers .
5,797,355 8/1998 Bourke et al. .
5,797,358 8/1998 Brandt et al. .
5,937,796 8/1999 Sebastiani .
5,941,200 8/1999 Boros et al. .

HEAT SENSITIVE AIR INLETS FOR WATER HEATERS

This application is a divisional of application Ser. No. 09/138,324, filed Aug. 21, 1998, incorporated herein by reference.

FIELD OF INVENTION

The present invention relates to air inlets for water heaters, particularly to improvements to gas fired water heaters adapted to render them safer for use.

BACKGROUND OF INVENTION

The most commonly used gas-fired water heater is the storage type, generally comprising an assembly of a water tank, a main burner to provide heat to the tank, a pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that the locations are also used for storage of other equipment such as lawn mowers, trimmers, snow blowers and the like. It is a common procedure for such machinery to be refueled in such locations.

There have been a number of reported instances of spilled gasoline and associated extraneous fumes being accidently ignited. There are many available ignition sources, such as refrigerators, running engines, electric motors, electric and gas dryers, electric light switches and the like. However, gas water heaters have sometimes been suspected because they often have a pilot flame.

Vapors from spilled or escaping flammable liquid or gaseous substances in a space in which an ignition source is present provides for ignition potential. "Extraneous fumes," "extraneous fumes species," "fumes" or "extraneous gases" are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

Many inter-related factors influence whether a particular fuel spillage leads to ignition. These factors include, among other things, the quantity, nature and physical properties of the particular type of spilled fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges are capable of enabling ignition are not reached given all the surrounding circumstances.

One surrounding circumstance is the relative density of the fumes. When a spilled liquid fuel spreads on a floor, normal evaporation occurs and fumes from the liquid form a mixture with the surrounding air that may, at some time and at some locations, be within the range that will ignite. For example, the range for common gasoline vapor is between about 2% and 8% gasoline with air, for butane between 1% and 10%. Such mixtures form and spread by a combination of processes including natural diffusion, forced convection due to air current drafts and by gravitationally affected upward displacement of molecules of one less dense gas or vapor by those of another more dense. Most common fuels stored in households are, as used, either gases with densities relatively close to that of air (eg. propane and butane) or liquids which form fumes having a density close to that of air, (eg. gasoline, which may contain butane and pentane among other components is very typical of such a liquid fuel).

In reconstructions of accidental ignition situations, and when gas water heaters are sometimes suspected and which involved spilled fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

The invention aims to substantially raise the probability of successful confinement of ignition of spilled flammable substances from typical spillage situations to the inside of the combustion chamber.

SUMMARY OF THE INVENTION

The invention relates to a water heater including a water container and a combustion chamber adjacent the container. The combustion chamber has at least one inlet to admit air and extraneous fumes into the combustion chamber. The inlet is formed from a heat sensitive material and has a plurality of ports. The inlet is capable of permitting air and extraneous fumes to enter the combustion chamber and prevents ignition of extraneous fumes outside of the combustion chamber. The water heater also includes a burner associated with the combustion chamber and arranged to combust fuel to heat water in the container.

DETAILED DESCRIPTION OF THE INVENTION

Figure 1:
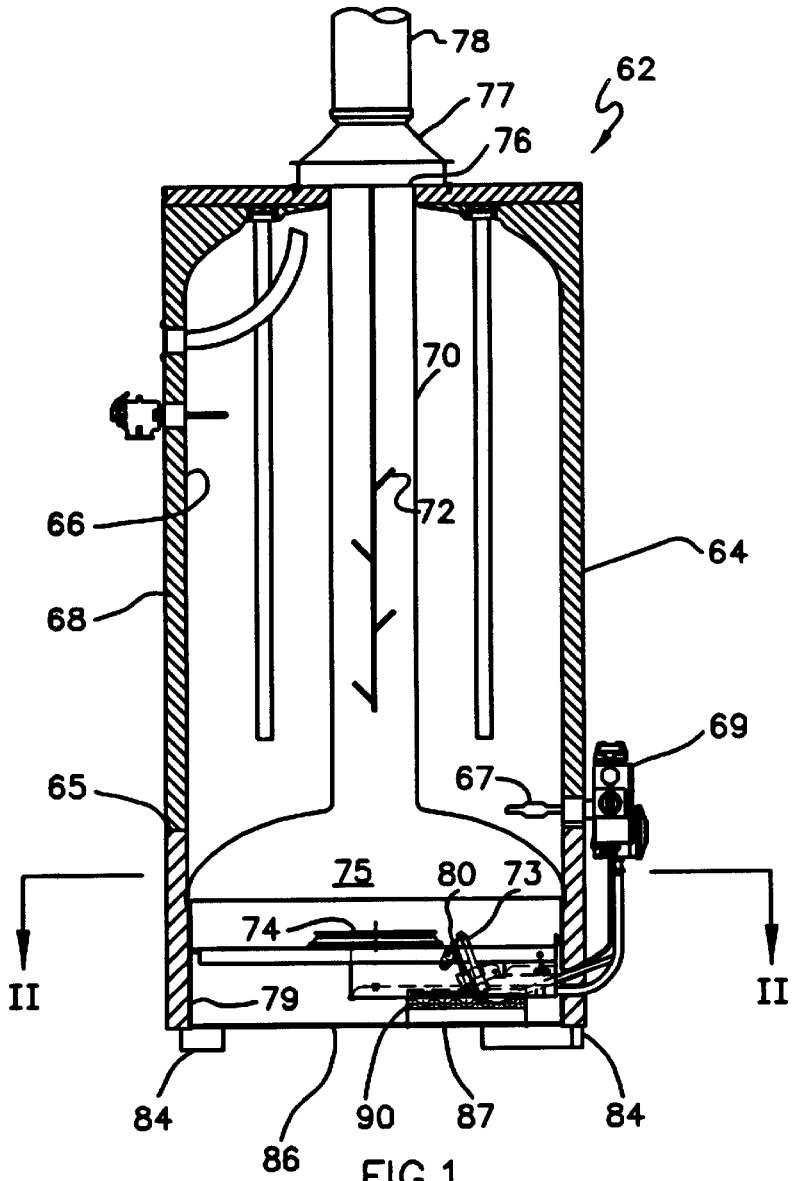
FIG. 1 is a schematic partial cross-sectional view of a gas-fueled water heater having a single air inlet according to aspects of the invention.

Conventional water heaters typically have their source(s) of ignition at or near floor level. In the course of attempting to develop appliance combustion chambers capable of confining flame inside appliances, it has been discovered that a type of air inlet constructed by forming holes in a sheet of heat sensitive material in a particular way has particular advantages in damage resistance when located at the bottom of a heavy appliance such as a water heater which generally stands on a floor. It has further been discovered that providing holes having well defined and in a controlled geometry assist reliability of the air intake and flame confining functions in a wide variety of circumstances.

A thin heat sensitive plate having many ports of closely specified size formed, cut, punched, perforated, etched, punctured and/or deformed through it at a specific spacing provides an excellent balance of performance, reliability and ease of accurate manufacture. In addition, the plate provides damage resistance prior to sale and delivery of a fuel burning appliance such as a water heater having such an air intake and during any subsequent installation of the appliance in a user's premises.

In experiments conducted with a number of metallic air inlets it was observed that some variants were more effective than others in flame confinement function. Certain ones enabled a flame to burn in close contact with the inside surface of the air inlet plate, thereby leading to substantial temperature rise of the plate on its outside surface, by heat conduction. In some instances, this was observed to involve turbulent combustion oscillations which further heated the inlet plate.

It was found that an excessive rising temperature of the perforated plate in contact with the flame could possibly transfer heat by conduction through the relatively thin metal plate to the extent that it could reach a sufficiently high temperature (of the order of 1250° F. or 675° C.) such that a failure might possibly occur under some conditions caused by hot surface ignition of the spilled fumes on the outside of the combustion chamber.

During experimentation, which was designed to create potential ignition conditions not likely to occur under normal operating conditions and, with a video camera filming the inside of the combustion chamber, it was discovered that a potential mode of failure occurred in some instances to involve heating particularly the periphery of the inlet plate at a faster rate than that in the center. Associated with this observation has been the phenomenon of the periphery of the inlet plate tending to closely retain the flames formed on the combustion chamber side of the air inlet plate, whereas towards the center, regardless of whether the air inlet plate is rectangular or circular in shape, there was evidently more of a tendency for flames to lift off the surface, further into the combustion chamber. Where the flames are closely retained the inlet plate becomes visibly hotter, which indicates excess temperature.

The invention addresses ways of meeting such extreme conditions. The invention also address ways of avoiding detonation wave type ignition that we discovered propagates from the inside to the outside of the combustion chamber through the inlet, plate under certain circumstances, by minimizing the amount of flammable fumes which may enter the combustion chamber before initial ignition inside the combustion chamber occurs; and, also, by avoiding prolonged combustion incidents.

It will be appreciated that the following description is intended to refer to the specific embodiments of the invention selected for illustration in the drawings and is not intended to limit or define the invention, other than in the appended claims.

Figure 2:
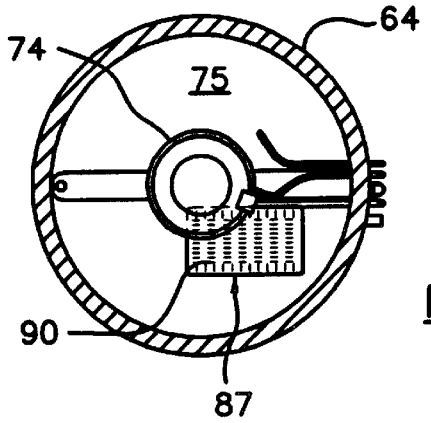
FIG. 2 is a cross-sectional view of a water heater taken through the line II—II in FIG. 1.

Turning now to the drawings in general and FIGS. 1 and 2 in particular, there is illustrated a storage type gas water heater 62 including jacket 64 which surrounds a water tank 66 and a main burner 74 in an enclosed chamber 75. Water tank 66 is preferably capable of holding heated water at mains pressure and is insulated preferably by foam insulation 68. Alternative insulation may include fiberglass or other types of fibrous insulation and the like. Fiberglass insulation surrounds chamber 75 at the lowermost portion of water tank 66. It is possible that heat resistant foam insulation can be used if desired. A foam dam 67 separates foam insulation 68 and the fiberglass insulation.

Located underneath water tank 66 is a pilot burner 73 and main burner 74 which preferably use natural gas as their fuel or other gases such as LPG, for example. Other suitable fuels may be substituted. Burners 73 and 74 combust gas admixed with air and the hot products of combustion resulting rise up through flue 70, possibly with heated air. Water tank 66 is lined with a glass coating for corrosion resistance. The thickness of the coating on the exterior surface of water tank 66 is about one half of the thickness of the interior facing surface to prevent "fish scaling". Also, the lower portion of flue 70 is coated to prevent scaling that could fall into chamber 75 and possibly partially block off air inlet plate 90.

The fuel gas is supplied to both burners (73, 74) through a gas valve 69. Flue 70 in this instance, contains a series of baffles 72 to better transfer heat generated by main burner 74 to water within tank 66. Near pilot burner 73 is a flame detecting thermocouple 80 which is a known safety measure to ensure that in the absence of a flame at pilot burner 73 the gas control valve 69 shuts off the gas supply. The water temperature sensor 67, preferably located inside the tank 66, co-operates also with the gas control valve 69 to supply gas to the main burner 74 on demand.

The products of combustion pass upwardly and out the top of jacket 64 via flue outlet 76 after heat has been transferred from the products of combustion. Flue outlet 76 discharges conventionally into a draft diverter 77 which in turn connects to an exhaust duct 78 leading outdoors.

Water heater 62 is mounted preferably on legs 84 to raise the base 86 of the combustion chamber 75 off the floor. In base 86 is an aperture 87 which is closed gas tightly by air inlet plate 90 which admits air for the combustion of the fuel gas combusted through the main burner 74 and pilot burner 73, regardless of the relative proportions of primary and secondary combustion air used by each burner. Air inlet plate 90 is preferably made from a thin perforated sheet of heat sensitive material such as plastic.

Where base 86 meets the vertical combustion chamber walls 79, adjoining surfaces can be either one piece or alternatively sealed to prevent ingress of air or flammable extraneous fumes. Gas, water, electrical, control or other connections, fittings or plumbing, wherever they pass through combustion chamber wall 79, are sealed. The combustion chamber 75 is air/gas tight except for means to supply combustion air and to exhaust combustion products through flue 70.

Pilot flame establishment can be achieved by a piezoelectric igniter. A pilot flame observation window can be provided which is sealed. Cold water is introduced at a low level of the tank 66 and withdrawn from a high level in any manner as already well known.

During normal operation, water heater 62 operates in substantially the same fashion as conventional water heaters except that air for combustion enters through air inlet plate 90. However, if spilled fuel or other flammable fluid is in the vicinity of water heater 62, then some extraneous fumes from the spilled substance may be drawn through plate 90 by virtue of the natural draft characteristic of such water heaters. Air inlet 90 allows the combustible extraneous fumes and air to enter, but confines potential ignition and combustion inside the combustion chamber 75.

The spilled substance is burned within combustion chamber 75 and exhausted through flue 70 via outlet 76 and duct 78. Because flame is confined by the air inlet plate 90 within the combustion chamber, flammable substance(s) external to water heater 62 will not be ignited.

The air inlet has mounted on or adjacent its upward facing surface a thermally sensitive fuse in series in an electrical circuit with pilot flame proving thermocouple 80 and a solenoid coil in gas valve 69.

With reference to FIG. 1, the size of air inlet plate 90 is dependent upon the air consumption requirement for proper combustion to meet mandated specifications to ensure low pollution burning of the gas fuel. Merely by way of general indication, the air inlet plate of FIG. 1 should be conveniently about 40 square inches of perforated area when fitted to a water heater having about 34,000 Btu/hr (approximate) energy consumption rating to meet ANSI requirements for overload combustion.

Figure 3:
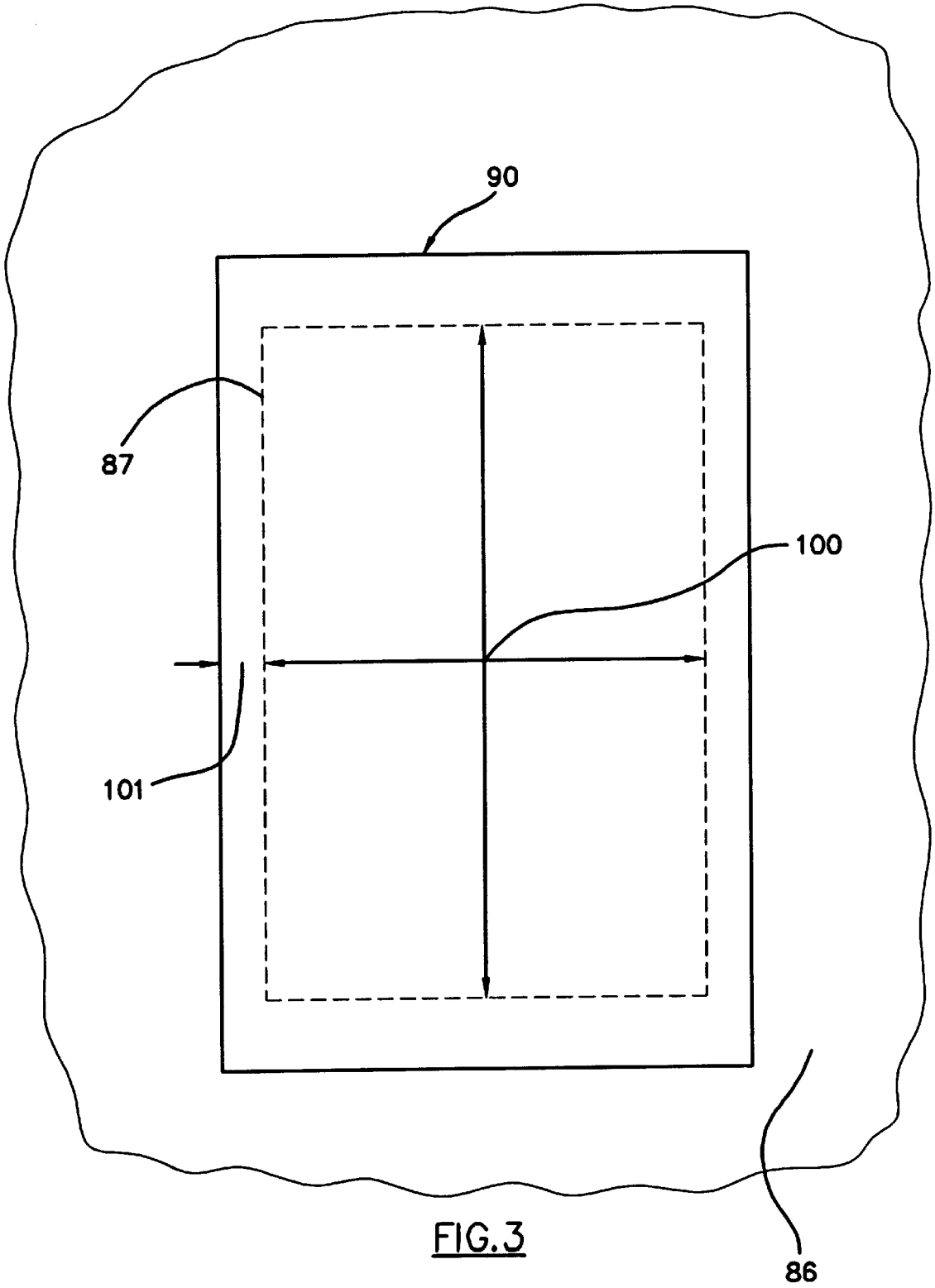
FIG. 3 is a schematic plan view depicting a portion of the base of a combustion chamber of a water heater including an air inlet.

FIG. 3 shows schematically an air inlet to a sealed combustion chamber comprising an aperture 87 in the lower wall 86 of the combustion chamber and a heat sensitive material or plastic air inlet plate 90 having a perforated area 100 and an unperforated border or flange 101.

Holes in the perforated area 100 of plate 90 can be circular or other shape although slotted holes have certain advantages as will be explained, the following description referring to slots.

Figure 4:
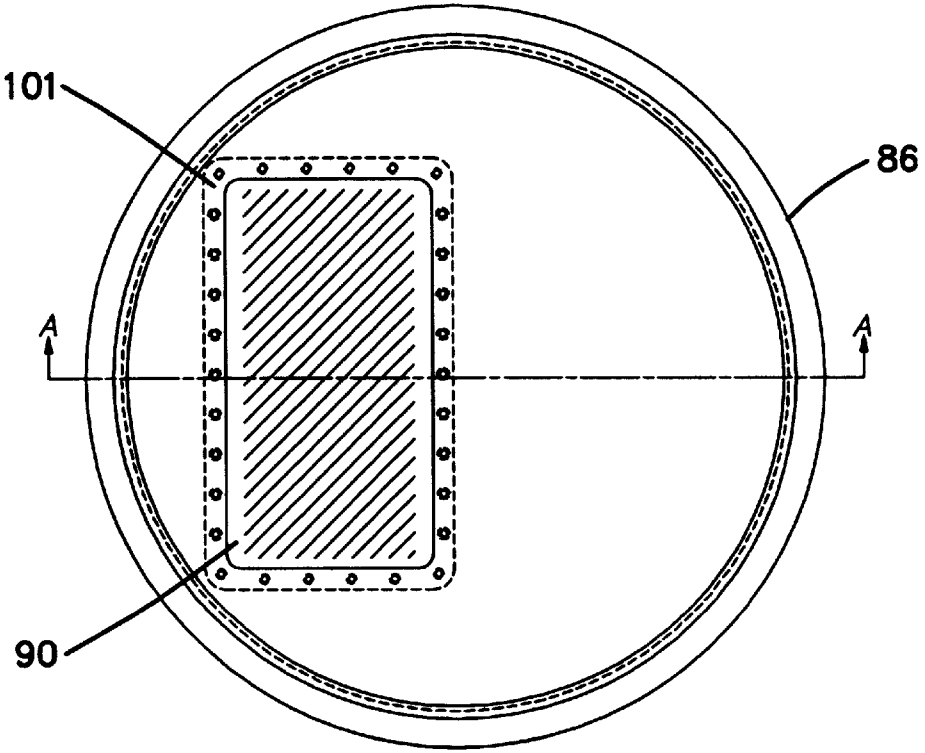
FIG. 4 is an enlarged schematic plan view of an air inlet shown in FIG. 2 with the burner and fuel supply apparatus removed for ease of understanding.
Figure 5:
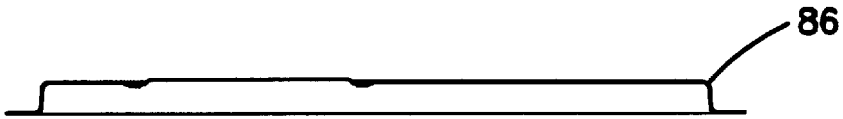
FIG. 5 is a cross-sectional view taken through the line A—A of FIG. 4.

FIGS. 4–5 show a preferred arrangement of air inlet 90 with respect to lower wall 86 of the combustion chamber.

It is intended that air inlet 90 be substantially sealed against lower wall 86 to prevent air and/or extraneous fumes to pass between facing surfaces of inlet 90 and lower wall 86. Inlet 90 has an outer flange 101 that extends beyond the edge of the opening in lower wall 86. Flange 101 may be attached to a corresponding portion of lower wall 86 by several methods such as forming, press-fitting or fasteners. Other means of securing or fixing air inlet 90 to lower wall 86 are possible, such as heat resistant adhesives and the like.

Air inlet 90 also most preferably has a raised portion 204 that extends above the upper surface of lower wall 86. This assists in ensuring that condensation generated in flue tube 70 does not lie or congregate on air inlet 90 so as to occlude the openings/slots therein.

Figure 6:
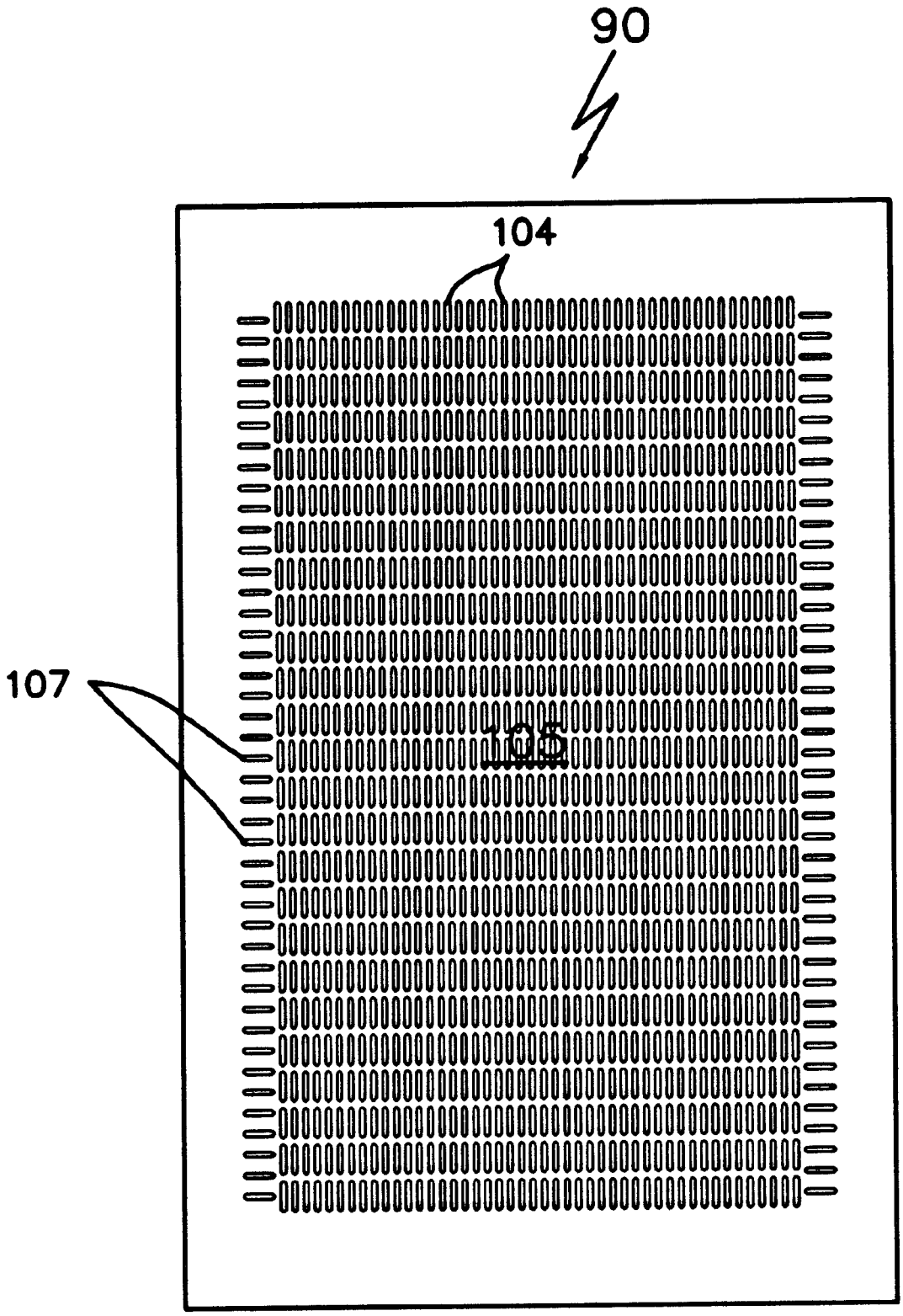
FIG. 6 shows a top plan view of a preferred air inlet of the invention.

FIG. 6 shows an air inlet 90 as will be described to admit air to combustion chamber 75. Air inlet 90 is most preferably a plastic plate having many small slots 104 passing through it. The air inlet should have a thickness of at least about 0.18 inches or more. Depending on the plastic and its mechanical properties, the thickness can be adjusted. Portions of air inlet 90 away from ports 104 need not be formed of the heat sensitive material since such portions need not deform in response to elevated temperatures.

FIG. 6 is a plan view of an air inlet plate having a series of ports in the shape of slots 104 aligned in rows. All such slots 104 have their longitudinal axes parallel except for the edge slots 107 at right angles to those of the ports 104 in the remaining perforated area 105. The ports are arranged in a rectangular pattern formed by the aligned rows. As mentioned above, the plate is most preferably at least about 0.18 inches thick. This provides air inlet 90 with adequate damage resistance and, in all other aspects, operates effectively. The total cross-sectional area of the slots 104 is selected on the basis of the flow rate of air required to pass through the air inlet 90 during normal and overload combustion.

The slots 104 are provided to allow sufficient combustion air through the air inlet 90 and there is no exact restriction on the total number of slots 104 or total area of the air inlet, both of which are determined by the capacity of a chosen gas (or fuel) burner to generate heat by combustion of a suitable quantity of gas with the required quantity of air to ensure complete combustion in the combustion chamber and the size and spacing of the slots 104. The air for combustion passes through the slots and not through any larger inlet air passage or passages to the combustion chamber. No such larger inlet is provided.

The water heater of the invention thus includes a water container and a combustion chamber adjacent to the container. The combustion chamber has at least one heat sensitive inlet to admit air and extraneous fume species into the combustion chamber. The inlet has a plurality of ports, each port having a limiting dimension sufficient to confine ignition and combustion of the extraneous fumes within the combustion chamber. The water heater also includes a burner associated with the combustion chamber and arranged to combust fuel to heat water in the container.

Figure 7:
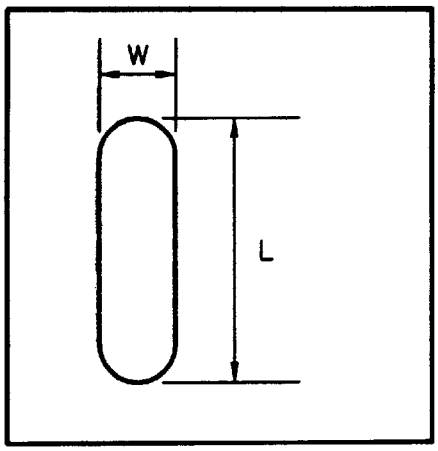
FIG. 7 illustrates a plan view of a single port taken from the air inlet shown in FIG. 6.

FIG. 7 shows a single slot 104 having a length L, width W and curved ends. To confine any incident of the above-mentioned accidental ignition inside the combustion chamber 75, the slots 104 should be formed having at least about twice the length L as the width W and are preferably at least about twelve times as long. Length to width (L/W) ratios outside these limits are also effective. Slots are more effective in controlling accidental deflagration or detonation ignition than circular holes, although beneficial effect can be observed with L/W ratios in slots as low as about 3. Above L/W ratios of about 15 there can be a disadvantage in that in an air inlet 90 of thin flexible plastic possible distortion of one or more slots 104 may be possible as would tend to allow opening at the center of the slots creating a loss of dimensional control of the width W. However, if temperature and distortion can be controlled then longer slots can be useful; reinforcement of a thin inlet plate by some form of stiffening, such as cross-breaking, can assist adoption of greater L/W ratios. L/W ratios greater than about 15 are otherwise useful to maximize air flow rates. A particularly preferred length L is about 6 mm and a particularly preferred W is about 0.5 mm.

To perform their ignition confinement function, it is important that the slots 104 perform in respect of any species of extraneous flammable fumes which may reasonably be expected to be involved in a possible spillage external to the combustion chamber 75 of which the air inlet of the invention forms an integral part or an appendage.

Figure 8:
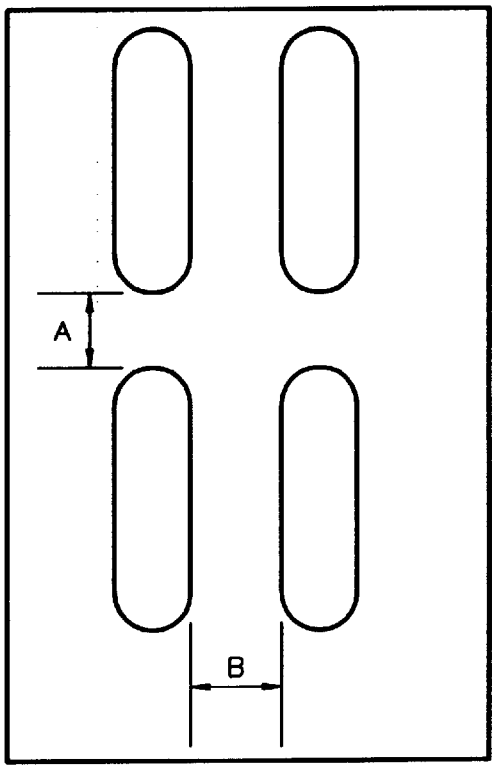
FIG. 8 is a detailed plan view of the spacing of part of the arrangement of ports on the inlet plate of FIG. 6.

FIG. 8 shows slot and inter-port spacing dimensions adopted in the embodiment depicted in FIG. 6. The dimensions of the ports are preferably the same as in FIG. 7 and have a length L of 6 mm and a width W of 0.5 mm. The ends of each slot are semicircular but more squarely ended slots are suitable. The chosen manufacturing process can influence the actual plan view shape of the slot. Blanking such large numbers of holes can be difficult as regards maintaining such small punches if the corner radii are not well rounded. The photochemical machining process of manufacture of air inlets 90 with slots 104 is also more adapted to maintaining round cornered slots.

The interport spacing illustrated in FIG. 8 performs the required confinement function in the previously described situation. The dimensions are preferably as follows: A about 2.0 mm and B about 2.0 mm.

Figure 9:
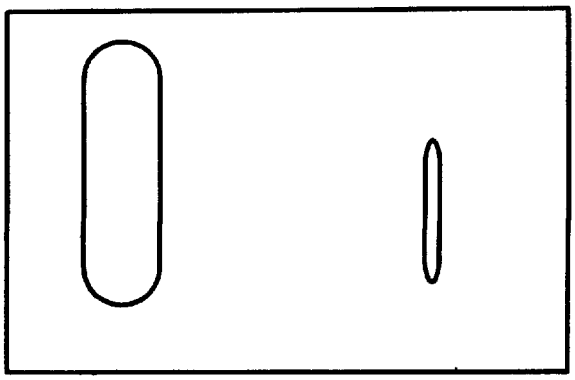
FIG. 9 shows two adjacent ports, taken from an air inlet of the type shown in FIG. 6, the left hand port depicting a state prior to exposure to heat caused by combusted vapors and the right hand port depicting a state subsequent to exposure to heat caused by combusted vapors.
Figure 11:
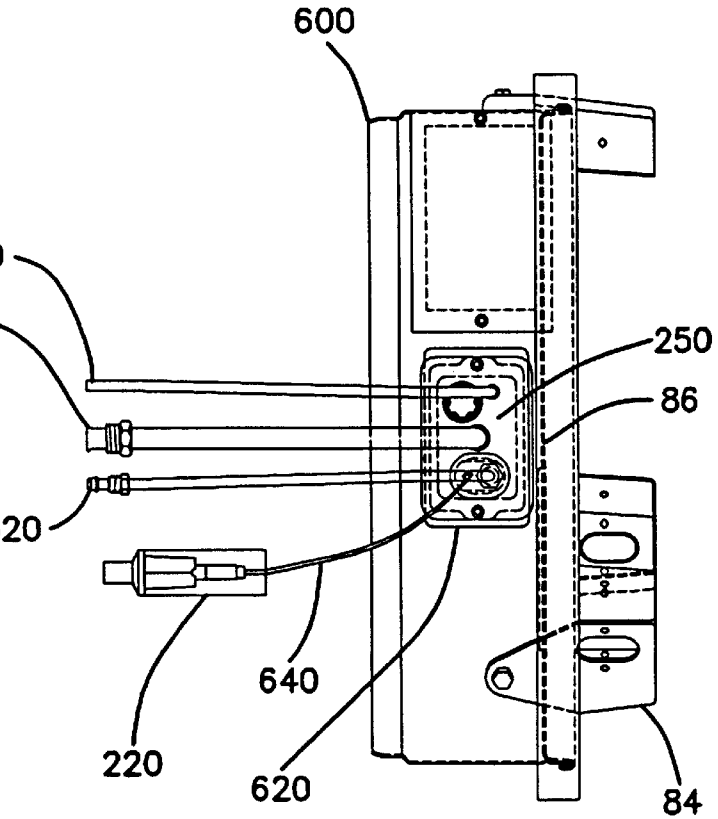
FIG. 11 is a side view of the structure illustrated in FIG. 10 rotated by 90°.
Figure 10:
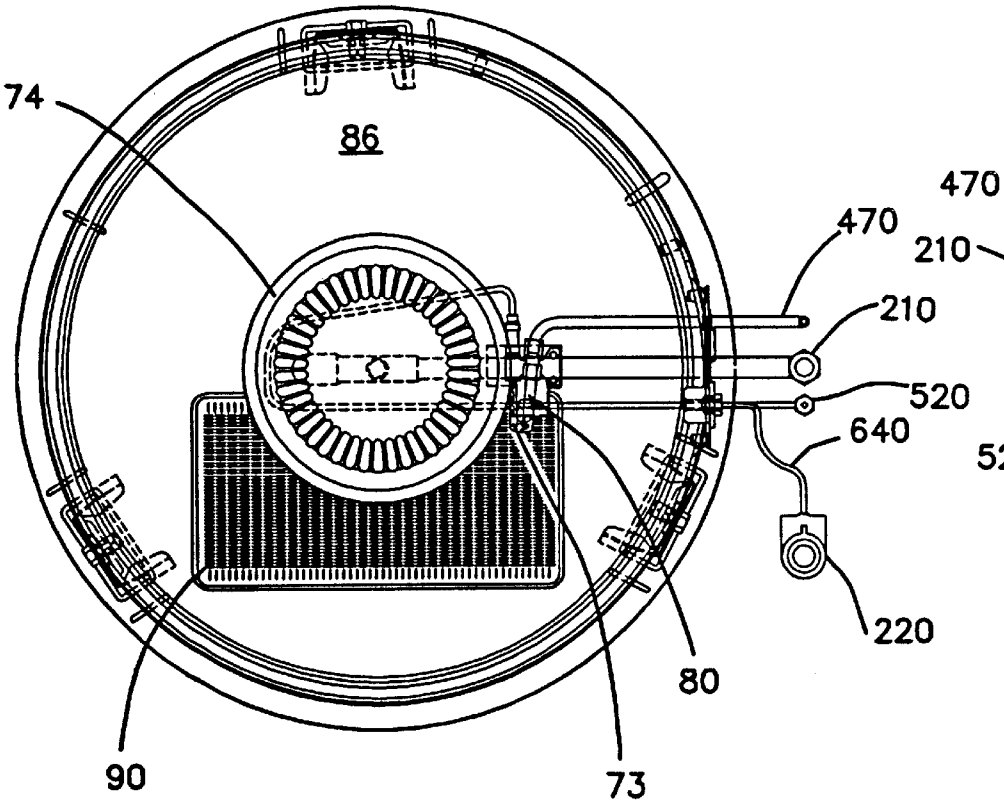
FIG. 10 is a top plan view of a main burner, pilot burner, thermocouple and air inlet arrangement in a combustion chamber of an especially preferred embodiment of the invention.
Figure 12:
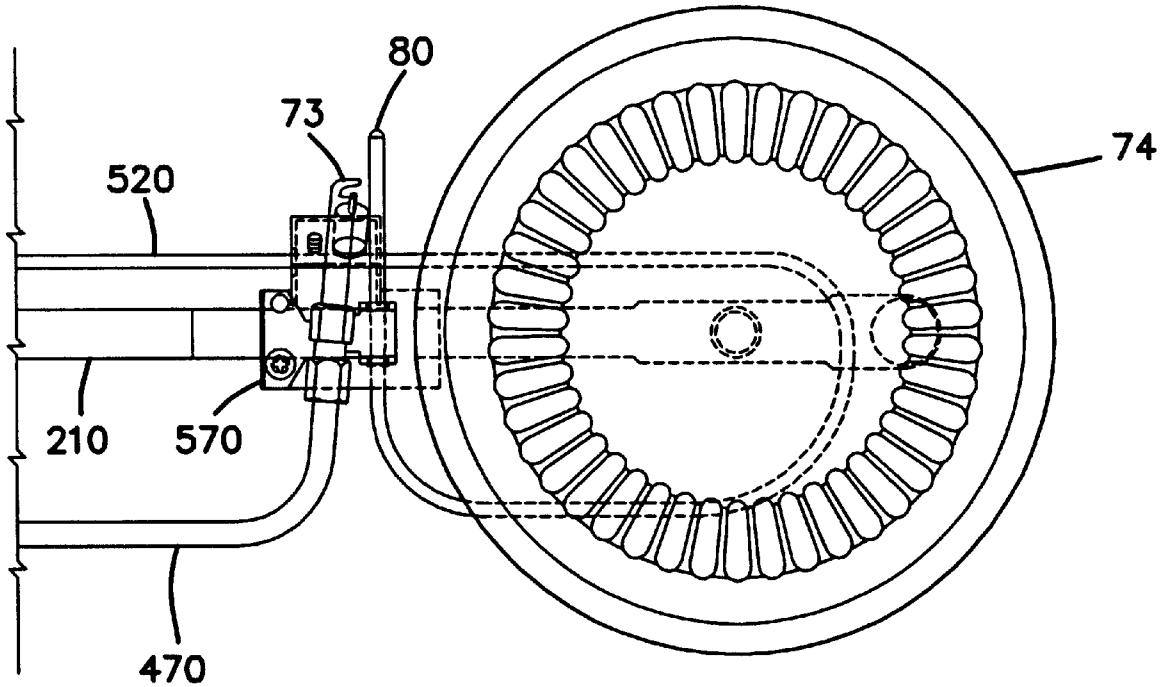
FIG. 12 is an exploded view of the main burner, pilot burner and thermocouple arrangement shown in FIG. 10.
Figure 13:
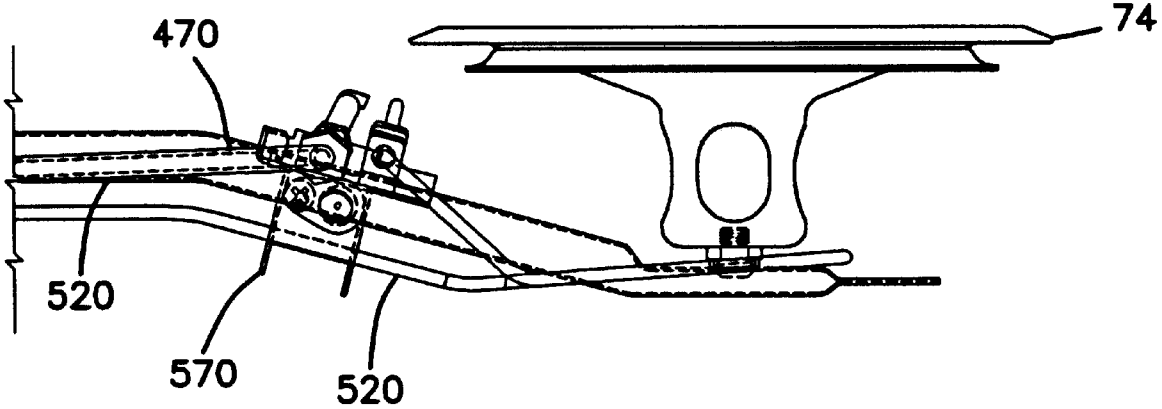
FIG. 13 is a side view of the structure illustrated in FIG. 12 rotated by 90°.

FIG. 9 shows a port 104 in two states, one state shown on the left hand being a port prior to exposure to heat caused by combusted vapors or fumes and the right hand drawing showing a port depicting a state subsequent to exposure to heat caused by combusted vapors or fumes. The change in size and shape of port 104 as shown in FIG. 9 is brought about as a result of ignition of extraneous fumes having passed through air inlet 90 and ignited on the surface of air inlet 90 facing combustion chamber 75. The presence of flames at or near the surface of air inlet 90 causes its temperature to increase, thereby causing the heat sensitive material forming the air inlet to increase and at a particular point begin to soften and approach and/or reach its melting temperature at which point the walls or edges of port 104 begin to change in shape and the port shrinks as the material of the plate flows and fills into the port.

The result of the decrease in the total open space of the air inlet is the decrease in entry of air and extraneous fumes into the combustion chamber, thereby reducing combustion and, given sufficient time, choking off combustion all together.

Of course, there are a multiplicity of ports 104 in air inlet 90. Some of ports 104 may be caused to close off completely while leaving others slightly open, but not sufficiently to permit continued combustion within the combustion chamber.

Materials suitable for forming the heat sensitive or plastic air inlet 90 should most preferably possess crystalline characteristics such that the heat sensitive material or plastic will flow or partially flow when heated. In addition, the material should possess heat deflection temperatures in excess of about 400° F. and melting points in excess of about 500° F. Amaco polymers AMODEL, a glass fiber-reinforced grade of polyphthalamide (PPA) resin or Phillips 66 RYTON, a glass fiber-filled polyphenylene sulfide (PPS) compound are especially preferred examples of suitable materials for plastic air inlets. Of course, other materials having the appropriate heat sensitivity, machinability, strength and durability may be utilized.

Referring to FIGS. 10–13, they collectively show fuel supply line 210 and pilot fuel line 470 extending outwardly from a plate 250. Plate 250 is removably sealable to skirt 600 that forms the side wall of combustion chamber 75. Plate 250 is held into position by a pair of screws 620 or by any other suitable means. Pilot fuel line 470 and fuel supply line 210 pass through plate 250 in a substantially fixed and sealed condition. Sheath 520 also extends through plate 250 in a substantially fixed and sealed condition as does igniter line 640. Igniter line 640 connects on one end to an igniter button 220 and a piezo igniter 660 on its other end. Igniter button 220 can be obtained from Channel Products, for example. Each of pilot fuel supply line 470, fuel supply line 210 and sheath 520 are removably connectable to gas control valve 69 by compression nuts. Each of the compression nuts are threaded and threadingly engage control valve 69.

Sheath 520, preferably made of copper, contains wires (not shown) from thermocouple 80 to ensure that, in the absence of a flame at pilot burner 73, gas control valve 69 shuts off the gas supply. Thermocouple 80 may be selected from those known in the art. Robertshaw Model No. TS 750U is preferred.

The pilot burner to air inlet relationship is quite important in stand-by or pilot only mode of operation. The hood of pilot burner 73 should be located over ports 104. This creates conditions for smooth ignition of flammable vapors as they flow through the ports. A pilot located away from the ports can result in at least two undesirable conditions: rough ignition of vapors and delayed ignition of vapors which could result in a small deflagration within combustion chamber 75. This deflagration could possibly produce a pressure wave which could push flames through ports 104 and ignite any vapors remaining outside the water heater.

The location of thermocouple 80 is important. Quick shutdown of gas valve 69 is desirable for several reasons. Disablement of gas valve 69 results in pilot burner 73 outage and subsequent main burner 74 shutdown. Therefore, main burner 74 cannot be ignited, which may result in the development of undesirable pressure waves within combustion chamber 15 while flammable vapors are being consumed on the air inlet plate. Flammable vapor spills may result in vapor concentrations that migrate in and out of the flammable range. Vapors adjacent air inlet 90 may ignite and be consumed for a short period of time before ports 104 have an opportunity to reduce in size or close off extraneous fumes in order to self-extinguish. Disablement of gas valve 69 (i.e. pilot burner 73 and main burner 74 shutdown) removes the water heater as a source of ignition in the event that vapors should again reach a flammable concentration level.

It is to be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made to them, without departing from the scope of the present invention.

What is claimed is:

1. An air inlet for a water heater combustion chamber that is subject to exposure to extraneous fumes comprising a plate at least partially formed of a heat sensitive material to admit air and extraneous fumes into said combustion chamber, said plate being capable of permitting air and extraneous fumes to enter said combustion chamber to be combusted and, upon initiation of combustion, capable of deforming in response to elevated temperatures and limiting further entry of air and extraneous fumes into said combustion chamber.

2. The air inlet defined in claim 1, wherein said heat sensitive material is a plastic.

3. The air inlet defined in claim 2, wherein said plastic is selected from the group consisting of polyphenylene sulfide resin and polyphthalamide resin.

4. The air inlet defined in claim 2, wherein said plastic contains glass fibers.

5. The air inlet defined in claim 1, wherein said plate has a plurality of ports that are capable of shrinking when exposed to elevated temperatures.

6. The air inlet defined in claim 5, wherein said ports comprise slots.

7. The air inlet defined in claim 1, wherein said heat sensitive material has a heat deflection temperature of about 400° F. or more.

8. The air inlet defined in claim 1, wherein said plate has a plurality of ports, at least one of which is adjacent a pilot burner associated with said combustion chamber to ignite said extraneous fumes as they pass into said combustion chamber and before there is a potentially explosive accumulation of fumes in said combustion chamber.

9. The air inlet defined in claim 1, wherein said heat sensitive material has a melting point of about 500° F. or more.

10. The air inlet defined in claim 1, wherein said ports are arranged in rows.

11. An air inlet for a water heater combustion chamber that is subject to exposure to extraneous fumes comprising a plastic plate having a plurality of holes adapted to admit air and extraneous fumes into the combustion chamber and prevent ignition of remaining extraneous fumes outside of the combustion chamber, said holes in said plastic inlet being capable of deforming upon exposure to elevated temperatures and decreasing entry of further amounts of air and extraneous fumes into said combustion chamber.

12. An air inlet for a water heater combustion chamber that is subject to exposure to extraneous fumes comprising a heat sensitive plate having a plurality of holes associated with the combustion chamber adapted to admit air and extraneous fumes into the combustion chamber and prevent ignition of extraneous fumes outside of the combustion chamber, said holes being capable of shrinking in size upon exposure to elevated temperatures, thereby limiting further entry of air and extraneous fumes into said combustion chamber.

* * * * *